United States Patent [19]

Stark et al.

[11] Patent Number: 4,544,093

[45] Date of Patent: Oct. 1, 1985

[54] EDGE-BONDING OF SHEET MATERIAL

[75] Inventors: Sven O. S. Stark, Rydsgard; Lars-Olof Andersson, Dalby, both of Sweden

[73] Assignee: Tetra Pak International AB, Lund, Sweden

[21] Appl. No.: 536,271

[22] Filed: Sep. 27, 1983

[30] Foreign Application Priority Data

Oct. 5, 1982 [GB] United Kingdom ..... 8228403

[51] Int. Cl.[4] ..... B65D 5/64; B65D 43/00

[52] U.S. Cl. ..... 229/43; 229/48 SA; 229/48 SB; 229/48 T; 220/359

[58] Field of Search ..... 229/43, 44 R, 7 R, 48 R, 229/48 SA, 48 SB, 487; 220/359; 215/232

[56] References Cited

U.S. PATENT DOCUMENTS

| | | | |
|---|---|---|---|
| 4,167,234 | 9/1979 | Gordon et al. | 220/359 |
| 4,207,989 | 6/1980 | Ingemann | 220/359 |
| 4,209,126 | 6/1980 | Elias | 220/359 |
| 4,234,121 | 11/1980 | Sasaki | 220/359 |
| 4,280,653 | 7/1981 | Elias | 220/359 |
| 4,328,905 | 5/1982 | Hardt | 220/359 |
| 4,346,833 | 8/1982 | Bernhardt | 220/359 |
| 4,448,345 | 5/1984 | Helms | 220/359 |

*Primary Examiner*—Joseph Man-Fu Moy

*Attorney, Agent, or Firm*—Oblon, Fisher, Spivak, McClelland & Maier

[57] ABSTRACT

When a packaging container is formed by sealing an area of sheet material to the edge of another area of sheet material, the L-joint or T-joint so formed is sometimes liable to rupture when subjected to blows or strain. According to this invention that danger is reduced or eliminated by moulding a zone (4) of an end closure panel (3) abutting on the container wall edge to which it is jointed so that it forms a flange resting against and bonded to the face of said wall (1). The flange may be provided with a lip (6) projecting from a short length of the edge of said closure panel.

3 Claims, 3 Drawing Figures

Figure 1:
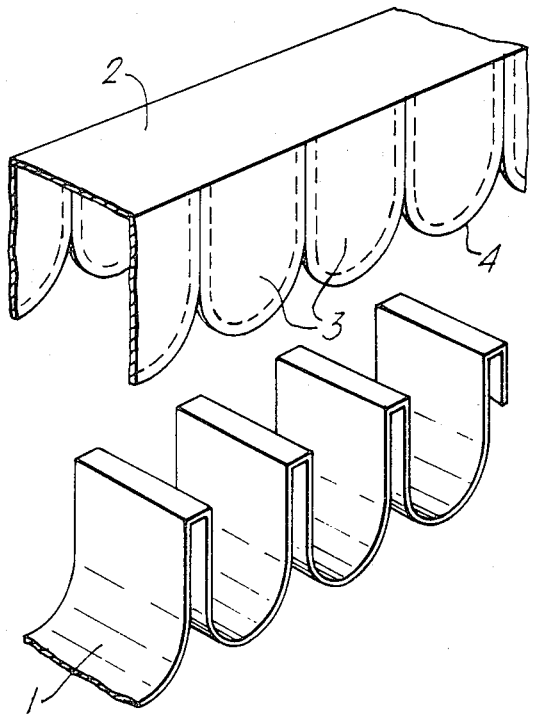

Fig. 2.
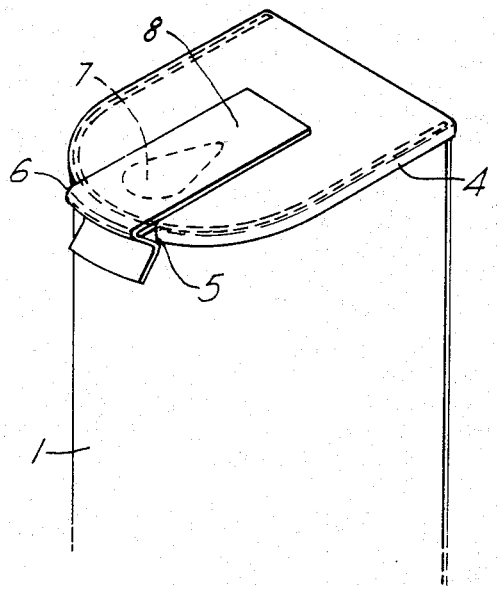
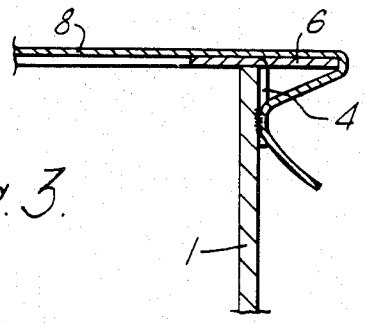
Fig. 3.

EDGE-BONDING OF SHEET MATERIAL

This invention relates to the edge-bonding of two areas of sheet material formed of, or coated with, plastics material in the course of bonding of sheet packaging material during the formation of a packaging container therefrom.

It is known (e.g. in a previously disclosed packaging container) to apply the face of one area of sheet packaging material to the edge of another area of sheet material, and to bond them together by a T-joint or an L-joint. If such a joint is subjected to strain or percussion, there is a danger of rupture at one or more points of the line-seal between the edge of one area and the face of the other area.

The object of the present invention is to reduce or eliminate the risk of such rupture, and with this end in view the invention consists in a method of securing an end-closure panel to the body of a packaging container wherein said panel is located in contact with the edge of the container body wall and bonded therewith to form a T-joint, and an edge zone of said panel projecting beyond. Said body wall is folded down by moulding into contact with the outer surface of said body wall and is heat-sealed thereto.

The invention further consists in a packaging container comprising a container body wall and an end closure panel secured to the edge of said wall by T-joint sealing, with a zone of said closure panel projecting beyond said body wall turned down by moulding into contact with the exterior of said wall and bonded as a flange thereto.

The end panel may be provided with an outlet aperture sealed by a tear-away strip, and to facilitate pouring a short length of the down-turned flange may be left unfolded as a projection in the plane of the end closure panel.

This invention is more especially applicable to a known form of packaging container, and a form of the present invention, when applied to such a known container, will now be described, by way of example only, with reference to the accompanying drawings wherein FIG. 1 represents in perspective two webs of packaging material preformed, and in process of being attached to one another for the production of a line of said known packaging containers, but modified to incorporate features of the present invention;

FIG. 2 represents a perspective view of the upper part of a packaging container incorporating the present invention; and FIG. 3 represents a slightly enlarged cross-section of part of the container shown in FIG. 2.

A known form of packaging container is formed from two webs of packaging material in a manner which can be understood by reference to FIG. 1 of the accompanying drawings. One web 1 is formed in moulds into a series of transverse troughs as illustrated, while the other web is formed to provide a mid-strip 2 of substantially the same width as the web 1 with side flaps or panels 3 of substantially the same size and shape as the end openings of the troughs of web 1. The strip 2 is bonded to the upper surfaces of the transverse partitioning walls between the troughs of web 1, and the flaps 3 are folded against and bonded to the end edges of the troughs of web 1. Thus each trough, and a portion of the strip 2 extending between its opposite partition walls form the body wall of a container closed at its ends by panels 3 bonded by a T-joint or L-joint to the edges of the web 1 forming the trough, and these containers may be separated from one another by cutting along the flat strips of the web 1 forming the top edges of the partitions between the troughs.

The webs may be of foamed plastics material, and a description of the manufacture of such containers may be found in British patent specification No. 1454464 and others. A description of a modified form of such containers from webs of plastics-coated paper or laminate will be found in British patent specification No. 81 12214, now granted as United Kingdom Pat. No. 2,098,921. It will be appreciated that in all these previously described containers, the end closure flaps 3 are bonded to the trough-sections of web 1 solely by a line-bound L-joint where the flaps 3 abut on the edges of the web 1, and while such joints may often be quite satisfactory, there may, in some circumstances, be a danger that a joint may be ruptured if the filled container is subjected to strain or blows.

The present invention aims at the reduction or elimination of this risk. For this purpose the flaps or panels 3 are extended at their edges to form edge strips 4 (FIG. 1) which, when the flaps 3 are folded against the edges of the troughs of web 1 project beyond the trough edges. When a flap or panel 3 is folded against the edge of a trough it is bonded thereto by heat-sealing to form a T-joint. Simultaneously with, or promptly after, the bonding of this T-joint the narrow extended edge-zone of the panel 3 projecting beyond the trough edge (between the dotted lines and panel edges seen in FIG. 1) is caused by moulding to conform with the outer surface of the container wall formed by the trough, and to make close contact therewith whereupon it is bonded thereto in the form of a flange, by heat-sealing. To achieve this result the upper web of FIG. 1, comprising the strip 2 and panels 3 is of plastics material, and preferably of foamed plastics. The web 1 may also be of plastics or foamed plastics material, or of plastics-coated paper or laminate, as previously disclosed.

It will be appreciated that the bonded flange 4 adds much strength to the T-joint line bond which held the panel 3 to the container body in previously known containers. To facilitate access to, and emission of the contents of the container the closure panel 3 may be provided with a conventional outlet aperture 7, sealed by a tear-away strip 8. To facilitate pouring, when the strip 8 is removed, a short length of the flange 4 in line with the pouring aperture may be left, unfolded, as a flat extension 6 of the panel 3. If desired this extension may be separated from the remainder of the flange 4 by slits or cuts 5, and the sealing strip 8 may then extend over this projecting lip constituted by the extension 6, and folded back for attachment to the container wall 1.

We claim:

1. A packaging container comprising:

a substantially tubular body formed with a wall having at least one edge;

a planar end closure panel being secured to one said at least one edge by a T-joint seal such that a zone of said closure panel projects beyond said body wall, a portion of said edge zone being separated from a remainder of said edge zone by cuts, wherein only said remainder of said edge zone is turned down by molding and bonded to the exterior of said body wall, said portion of said edge zone forming a flat lip in the plane of said closure panel;

an outlet aperture in said end closure panel;

a tear away tab attached to said end closure panel and covering said outlet aperture, said tear away tab being aligned with said portion of said edge zone forming said lip, said tear away tab having a portion projecting beyond said lip and being folded over said lip and attached to said exterior of said body wall.

2. A packaging container in accordance with claim 1 wherein said body comprises:

a substantially rectangular area of sheet material formed as a trough of substantially U-section, said trough having rectilinear edges, a flat, substantially rectangular area of sheet material bonded to said rectilinear edges of said trough; and end-closure panels integral with said flat area of sheet material, said end-closure panels being folded and bonded to the curved edges and exterior of said trough.

3. A packaging container in accordance with claim 2, wherein said projecting lip and aligned tear-away tab are located substantially midway of the curved trough wall.

* * * * *